United States Patent [19]

Sedlik

[11] Patent Number: 4,881,706

[45] Date of Patent: Nov. 21, 1989

[54] HOLDER FOR HANDLE BAGS

[76] Inventor: Brian R. Sedlik, 3170 Madison, Apt. 4, Carlsbad, Calif. 92008

[21] Appl. No.: 215,284

[22] Filed: Jul. 5, 1988

[51] Int. Cl.[4] ..... B65B 67/12

[52] U.S. Cl. ..... 248/99; 248/150; 248/100

[58] Field of Search ..... 248/99, 100, 95, 101, 248/150; 220/1 T, 18, 85 H

[56] References Cited

U.S. PATENT DOCUMENTS

| | | | |
|---|---|---|---|
| 477,235 | 6/1892 | Timmerman | 248/99 |
| 2,305,863 | 12/1942 | Ginter | 248/100 |
| 4,458,867 | 7/1984 | Malik | 248/99 X |
| 4,638,968 | 1/1987 | Auten | 248/100 X |
| 4,669,689 | 6/1987 | Jones | 248/99 |
| 4,695,020 | 9/1987 | Collins | 248/100 |
| 4,750,695 | 6/1988 | Greenhouse | 248/99 |

FOREIGN PATENT DOCUMENTS

| | | | |
|---|---|---|---|
| 221765 | 10/1909 | Fed. Rep. of Germany | 248/99 |
| 2919860 | 11/1980 | Fed. Rep. of Germany | 248/100 |

*Primary Examiner*—Ramon S. Britts
*Assistant Examiner*—Karen J. Chotkowski
*Attorney, Agent, or Firm*—Baker, Maxham, Jester & Meador

[57] ABSTRACT

A holder to maintain a handle-type bag in open condition. A back and two spaced forwardly projecting arms are configured with notches to securely retain the bag handle and top edges to maintain the thus mounted bag in fully open condition.

17 Claims, 1 Drawing Sheet

FIG. 1
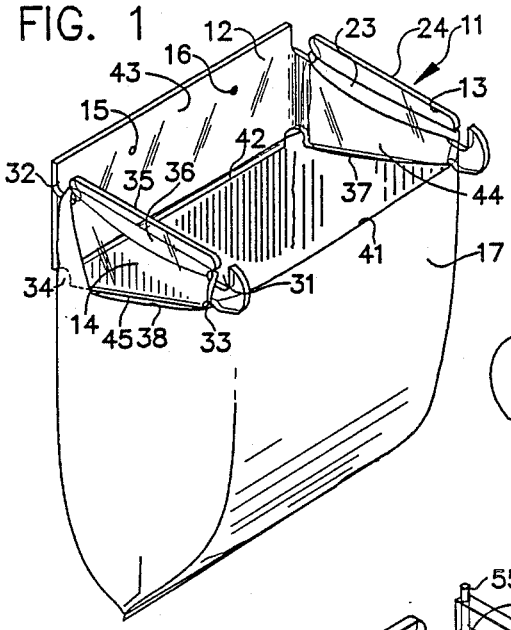
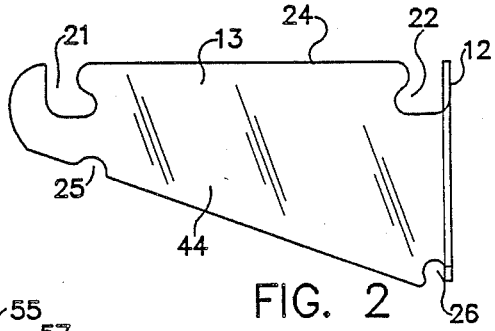
FIG. 2
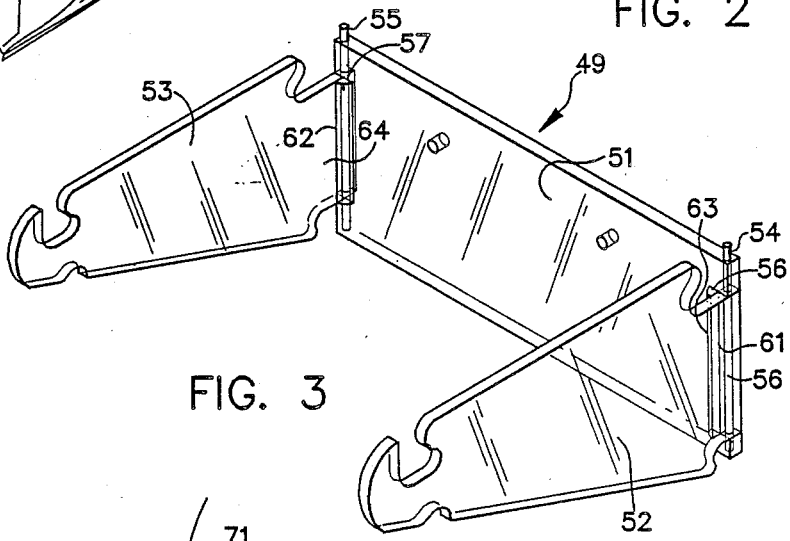
FIG. 3
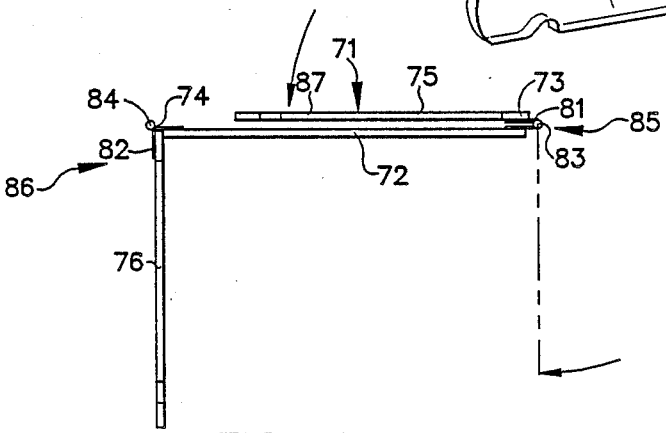
FIG. 4

HOLDER FOR HANDLE BAGS

FIELD OF THE INVENTION

This invention relates generally to trash bag holders and more particularly concerns apparatus for retaining handle type bags in a positive open condition to receive refuse.

BACKGROUND OF THE INVENTION

There are many devices for holding household trash bags in at least a somewhat open condition, intended to conveniently receive refuse. These devices range from waste baskets to wire frames and metal, wood or plastic holders. Some holders apply to plastic bags having handles of the type currently used in many retail stores.

Some of these holder devices are relatively complex in their efforts to provide convenience in holding the bag and keeping its top open. Some appear to work reasonably well while others perform only marginally for their intended purpose.

SUMMARY OF THE INVENTION

It is an object of this invention to provide a means to recycle plastic retail store bags of the handle type to enable them to be efficiently employed to receive and aid in disposing of refuse. The apparatus is simple and inexpensive and provides means to hold the top of the bag open in a positive way.

A base or back member is easily mounted to a cupboard door, such as a door typically providing access under a kitchen sink. Two opposite side arm members extend forwardly and are formed with notches adapted to engage the loop handle and the top edges of the bag to not only hold it open but also to hold it closely against the back member to prevent refuse from falling between the bag and the cupboard door.

In a preferred embodiment, the side arm members fold against the back member. The side arms may also be removable for ease of packaging.

BRIEF DESCRIPTION OF THE DRAWING

The objects, features and advantages of the invention will be more readily perceived from the following detailed description when read in conjunction with the accompanying drawing, in which:

FIG. 1 is a perspective view of the holder of the invention with a bag in position thereon;

FIG. 2 is right end view of the holder of FIG. 1;

FIG. 3 is a perspective view of an alternative embodiment of the invention; and

FIG. 4 is top view of another embodiment of the invention.

DESCRIPTION OF THE PREFERRED EMBODIMENTS

With reference now to the drawing, and more particularly to FIGS. 1 and 2 thereof, there is shown holder 11 comprised of back member 12, right side arm member 13 and left side arm member 14. Back 12 is formed with holes 15 and 16 to facilitate attachment of the holder to a door or wall by appropriate means such as screws or bolts. Side arms 13 and 14 are shown fixed to back 12, extending therefrom at about 90°, forming a pair of substantially parallel retaining arms.

Arm 13 is formed with top handle notches 21 and 22. As seen in FIG. 1, handle 23 of bag 17 is securely and positively retained around central tab 24, which is formed between the handle notches, and through undercut front notch 21 and undercut rear notch 22. Bag upper edge notches 25 and 26 are formed in the bottom edge of arm 13. Arm 14 is formed with equivalent respective handle notches 31 and 32 defining central tab 35, and bag upper edge notches 33 and 34.

Side arms 13 and 14 are so shaped and configured with respect to bag 17 that when bag handles 23 and 36 are stretched around respective central tabs 24 and 35, portions 37, 38 and 41, 42 of the top edge of the bag are relatively taut. More particularly, front edge 41 holds in place with very little possible random motion and rear edge 42 is held closely against the lower portion of front side 43 of back 12. Bag edge portions 37 and 38 are retained tightly against the bottom edge area of arms 13 and 14, generally against the outside edge of central portions 44 and 45.

By this structure, in conjunction with the bag with which the holder is designed to cooperate, the bag remains open while retained by holder 11 and there is little possibility of refuse falling behind rear bag edge 42, or past side edges 37 and 38. Thus front side 43 of back 12 acts as a deflector or splash plate for refuse items not carefully placed in the bag. The holder and bag function together to be quite forgiving of relatively bad aim, thereby preventing elements of refuse from dropping to the floor, counter or cupboard from between the bag and the holder.

To remove and empty or discard bag 17, the handles are simply pulled off over tabs 24 and 35 and carried to the trash can, trash compactor or other place of disposal.

An alternative embodiment of the bag holder is shown in FIG. 3. Holder 49 is formed of five separate elements. These are back 51, right side arm member 52, lift side arm member 53 and connecting pins 54 and 55. For transportation and storage, pins 54 and 55 are removed and side arms 52 and 54 are placed flat on back 51.

Back 51 is formed with abutments 56 and 57 projecting forward by a distance approximately equal to the thickness of the back, having facing edges 61 and 62 which are substantially planar with the respective adjacent end edges of back 51. Inner facing sides 63 and 64 of arms 52 and 53 engage respective edges 61 and 62, thereby maintaining the arm members in substantially parallel relationship when inwardly directed pressure is applied, such as when a bag is mounted to the holder.

Except for the connections between the arms and the back, the structure and function of holder 49 is the same as holder 11.

Holder 71 is shown in FIG. 4, configured with swingable of pivotable arms on door hinge type structures. Back member 72 is formed with conventional interleaving hinge elements 73 and 74. Arm members 75 and 76 are formed with mating interleaving hinge elements 81 and 82. Pins 83 and 84 interconnect the respective right and left arm members' hinge elements to the respective back member hinge elements to form hinges 85 and 86. The orientation of hinges 85 and 86 is such that the arm members can fold flat against back surface 87 of back 72, the position shown generally for arm 75, for transportation and storage. Those arm members can be swung forwardly to a substantially 90° orientation with respect to back 72, as is the position of arm 76.

Thus the hinge structure, in conjunction with the mating surfaces at each end of back 72, will maintain arm members 75 and 76 in substantially parallel relationship when inwardly directed pressure is applied to them, as when a bag is mounted on holder 71. The operative structure and functioning of holder 71 with respect to a handle bag is as previously described with respect to the embodiment of FIGS. 1 and 2.

The materials used for the back and arm members are not critical. They need to be relatively rigid so they will not bend under normal use and may be plastic, wood or metal, among other materials. The hinge or pivoting member portions of the FIG. 3 embodiment are envisioned as being made of the same material as the back and side arms but need not be. The pins could be metal or other suitable material. The same is true for the hinges of the FIG. 4 embodiment.

The holder of this invention having separable back and arms as shown in FIG. 3 is the preferred embodiment. Any removable or hinge structure may be employed. The configurations of FIGS. 3 and 4 are provided only as examples of the structure that may be used. The back plate need not have any particular shape. It only requires some mounting means and end structure to which the arms are mounted. Further, it is possible that the entire structure could be free standing by means of a rack or the like, and not be mounted to a wall or door surface.

While it is contemplated that the arm members will project forwardly at a 90° angle with respect to the back, a few degree variation will not affect the functioning and usefulness of the invention. The handle notches could be upstanding members or hooking means rather than being cutouts in the upper edge of the arms. What is required is spaced handle engaging means over which the bag handle is stretched. Similarly, the bag edge notch means may have a different form than as shown, but spaced engaging means to retain the top edge of the bag close to the bottom edge of the side arm is what is required.

In view of the above description it is likely that modifications and improvements will occur to those skilled in this art which are within the scope of the appended claims.

I claim:

1. Bag holding apparatus for retaining a recyclable or disposable handle bag, said apparatus comprising:

an elongated back plate having first and second ends and front and back sides;

a first side arm member connected at said first end of said back plate and extending forwardly from said front side, said first side arm member having top and bottom edges;

a second side arm member connected at said second end of said back plate and extending forwardly from said front side substantially parallel to said first side arm member, said second side arm member having top and bottom edges;

spaced handle engaging means on said top edge of each said side arm member, said handle engaging means being adapted to positively retain the handle of the bag; and spaced bag edge engaging means on said bottom edge of each said side arm member, each said bag engaging means being positioned directly below respective said handle engaging means, each said bag edge engaging means being adapted to receive a portion of the top edge of the bag, which top edge when so engaged extends from said bag edge engaging means across the space between said side arm members, said bag edge engaging means being so spaced as to fully open the top of the bag when the top edge is engaged therewith;

the combination of said handle engaging means and said bag edge engaging means, when engaging the handle and the top edge of the bag, positively holding the bag fully open for receipt of refuse.

2. The apparatus recited in claim 1, wherein said back plate is formed with means for mounting said back plate to external structure.

3. The apparatus recited in claim 2, wherein said means for mounting comprises holes adapted to receive elongated mounting elements.

4. The apparatus recited in claim 1, wherein said handle engaging means comprises notch means in said top edge of said side arm members.

5. The apparatus recited in claim 4, and further comprising a tab formed between said handle notch means on each said side arm member, the bag handle extending around said tab and through said notch means when the bag is mounted to said apparatus.

6. The apparatus recited in claim 5, wherein said handle notch means are formed as undercut notches defining the ends of said tab.

7. The apparatus recited in claim 1, wherein said bag edge engaging means comprises notch means in said bottom edge of said side arm members.

8. The apparatus recited in claim 7, wherein said bag edge notch means comprises two spaced indentations in the bottom edge of said side arm members.

9. The apparatus recited in claim 1, wherein said bag edge engaging means are positioned generally beneath respective said handle engaging means.

10. The apparatus recited in claim 1, and further comprising means for pivotably mounting said side arm members to said back plate.

11. The apparatus recited in claim 10, and further comprising stop means to prevent said side arm members from pivoting toward each other substantially beyond an orientation about perpendicular to said back plate.

12. The apparatus recited in claim 10 wherein said side arm members are pivotable away from said front side of said back plate to a position flat against said back side thereof.

13. The apparatus recited in claim 10, wherein said pivotable mounting means further comprises means for removably connecting said side arm members to said back plate.

14. The apparatus recited in claim 1, and further comprising means for pivotably mounting said first and second side arm members to said back plate, said pivotable mounting means further comprising means for removably connecting said first and second side arm members to said back plate.

15. Bag holding apparatus for retaining a recyclable or disposable handle bag, said apparatus comprising:

an elongated back plate having first and second ends and front and back sides and being formed with means for mounting said back plate to external structure;

a first side arm member connected at said first end of said back plate and extending forwardly from said front side, said first side arm member having top and bottom edges and an inside and an outside surface;

a second side arm member connected at said second end of said back plate and extending forwardly from said front side substantially parallel to said first side arm member, said second side arm member having top and bottom edges and an inside and an outside surface, said respective inside surfaces of said first and second arm members being in facing relationship;

spaced handle engaging notch means in said top edge of each said side member forming a central tab therebetween, said notches being adapted to positively retain the handle of the bag which handle extends partially around said central tab when looped from outside inwardly over said central tab; and spaced bag edge engaging notch means formed as two spaced indentations in said bottom edge of each said side arm member, said indentations being directly beneath respective said handle notch means, each said bag edge engaging notch means being adapted to receive a portion of the top edge of the bag, which top edge when so engaged extends from outside said side arm members through said bag edge engaging means and across the space between said side arm members, said bag edge engaging means, said bag edge engaging means being so spaced as to fully open the top of the bag when the top edge is engaged therewith;

the combination of said handle engaging notch means and said bag edge engaging notch means, when engaging the handle and the top edge of the bag, positively holding the bag fully open for receipt of refuse.

16. The apparatus recited in claim 15, and further comprising means for pivotably mounting said first and second side arm members to said back plate, said pivotable mounting means further comprising means for removably connecting said first and second side arm members to said back plate.

17. Bag holding apparatus for retaining a recyclable or disposable handle bag, said apparatus comprising:

an elongated back plate having first and second ends and front and back sides;

a first side arm member connected at said first end of said back plate and extending forwardly from said front side, said first side arm member having top and bottom edges;

a second side arm member connected at said second end of said back plate and extending forwardly from said front side substantially parallel to said first side arm member, said second side arm member having top and bottom edges;

spaced handle engaging means on said top edge of each said side arm member, said handle engaging means being adapted to positively retain the handle of the bag; and spaced bag edge engaging means on said bottom edge of each said side arm member, each said bag edge engaging means being adapted to receive a portion of the top edge of the bag, one said bag edge engaging on each said side arm member being contiguous said back plate, the other said bag edge engaging means being spaced from said one bag edge engaging means so as to widely open the top of the bag when the top edge of the bag is engaged with said bag edge engaging means;

the combination of said handle engaging means and said bag edge engaging means, when engaging the handle and the top edge of the bag, positively holding the bag fully open for receipt of refuse and is held open against said back plate, thereby deterring refuse from falling between the bag and said back plate.

* * * * *